United States Patent [19]

Strauss

[11] Patent Number: 4,569,209

[45] Date of Patent: Feb. 11, 1986

[54] DEVICE FOR MAKING FRAGMENTED ICE

[75] Inventor: Friedhelm Strauss, Wiedensahl, Fed. Rep. of Germany

[73] Assignee: Intercontinentale Ziegra-Eismaschinen GmbH, Isernhagen, Fed. Rep. of Germany

[21] Appl. No.: 490,727

[22] Filed: May 2, 1983

[30] Foreign Application Priority Data

May 3, 1982 [DE] Fed. Rep. of Germany ..... 3216473

[51] Int. Cl.[4] ..... F25C 1/14

[52] U.S. Cl. ..... 62/320; 62/354

[58] Field of Search ..... 62/354, 320; 241/DIG. 17

[56] References Cited

U.S. PATENT DOCUMENTS

| | | | |
|---|---|---|---|
| 2,962,878 | 12/1960 | Keller | 62/320 |
| 3,034,311 | 5/1962 | Nelson | 62/320 |
| 3,126,719 | 3/1964 | Swatsick | 62/354 X |
| 3,196,628 | 7/1965 | Reynolds | 62/354 X |
| 3,256,710 | 6/1966 | Dedricks et al. | 62/354 X |
| 3,372,558 | 3/1968 | Guard | 62/320 |
| 4,429,551 | 2/1984 | Hizume | 62/354 |

*Primary Examiner*—William E. Tapolcai
*Attorney, Agent, or Firm*—Max Fogiel

[57] ABSTRACT

A device for making fragmented ice. It has a more or less vertical and externally chilled cylinder (1), a water intake at the bottom of the cylinder, an ice outlet (15) at the top of the cylinder, a powered conveyer worm (5) that is mounted in the cylinder and that continuously scrapes off the thin coating of ice that forms on the inside (2) of the wall of the cylinder with at least one thread (6 or 7) and conveys it in the form of a spiral (12) toward the ice outlet (15). It also has several cutters (16) distributed at regular intervals over the space (9) between the threads and a deflector (17) in the space between the threads and at the top of the threads to compact the ice and to produce grains or fragments of ice of desired dimensions and with a relatively narrow tolerance.

9 Claims, 5 Drawing Figures

DEVICE FOR MAKING FRAGMENTED ICE

Figure 1:
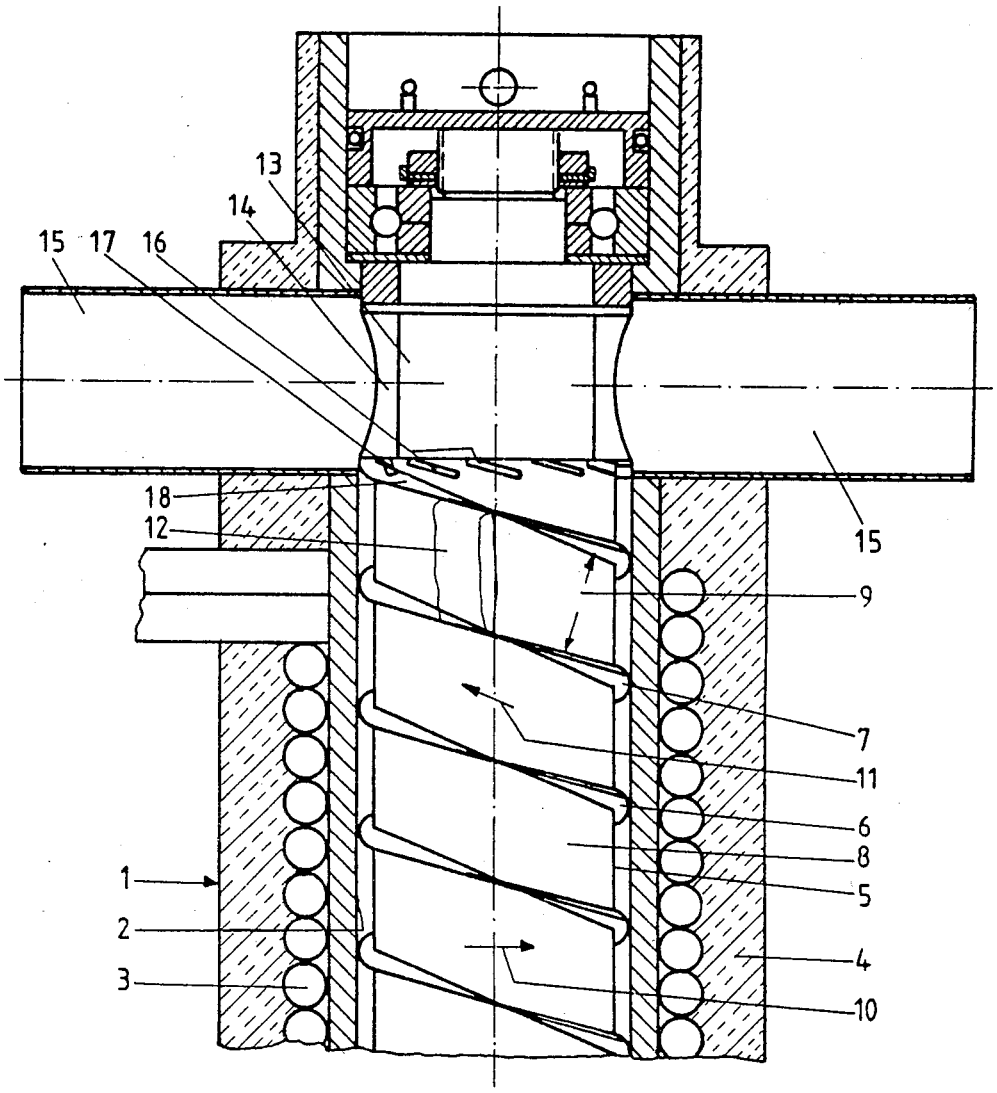

The invention concerns a device for making fragmented ice and having a more or less vertical and externally chilled cylinder, a water intake at the bottom of the cylinder, an ice outlet at the top of the cylinder, a powered conveyer worm that is mounted in the cylinder and that continuously scrapes off the thin coating of ice that forms on the inside of the wall of the cylinder with at least one thread and conveys it in the form of a spiral toward the ice outlet, and an obstruction in the space between the threads and at the top of the threads to break the spiral of ice up into fragments.

A device of this type is known from U.S. Pat. No. 3 326 014. It has a single-flight conveyer worm in the cylinder. It has catches between the turns of its single thread, which scrapes off the thin coating of ice on the inside of the cylinder wall, to convey the ice upward. Since there is a free space with an extensive cross-section at the top and in the vicinity of the ice outlet at the threadless section of the conveyer worm, the ice can not be compacted and drained of water at that point. At the transition between the threaded section of the worm and this annular space there is an obstruction in the form of a pin on the conveying side of the worm that rotates with the worm in relation to the housing. This pin is mounted at an angle to the axis of the worm and is obviously intended to break the spiral of ice up into fragments. Since, however, the obstruction does not actually compress the ice, the ice made by such a device can hardly be very compact, waterless, or hard-grained. Such ice would probably, due to the lack of compacting and draining, be rather slushy. Furthermore, if some or all of a spiral of ice gets into the space between the threads, the pin would break it up into fragments with very different dimensions. Such fragments would differ widely in shape and grain size.

A similar device is known from German Auslegeschrift No. 1 949 504. Its conveyer worm has an annular flange at the top and next to its unthreaded section. This flange compacts and drains water out of the ice that is conveyed against it. To affect the hardness and size of the fragments of ice in the ice outlet and to augment the compacting effect of the annular flange, there is a deflector pin just below the flange with respect to the sense in which the worm revolves and near and downstream of the ice outlet and a braking pin rigidly mounted near and upstream of the outlet. Both of these pins extend into the annular space. Although such obstructions do affect the granularity of the ice, the shape of the fragments will still vary widely. They will also range widely in size, including both very small and very large fragments.

The present invention is intended as an improved device of the type initially described in which the size of the fragments of ice can be set as desired and maintained between narrow limits. The device must of course also continue to compact and drain the ice so that the fragments will be hard enough and free enough of water. It should also be possible to design the device for the special application of making ice fragments of a specific desired cross-section, say 5 mm high by 5 mm wide, but with a length that could be varied as desired, for 3 to 6 mm for instance.

The invention achieves its objective in that the obstruction consists of several cutters distributed at regular intervals over the space between the threads and of a deflector engaging the conveying side of the thread, in that each of the cutters has an edge on the side that faces the conveying side of the thread, and in that each of the cutters has a deflecting surface adjoining its blade and the deflector a deflecting surface engaging the conveying side of the thread, with all the deflecting surfaces being parallel and positioned at an angle of approximately 50° to 60° to the direction in which the spiral of ice is conveyed. The edges and deflecting surfaces of the equally distributed cutters and of the deflectors fulfill several functions. Whereas the obstruction that is in the form of a pin at state of the art can not be expected to compact the ice, the system involving several cutters and a deflector surprisingly not only compacts and drains the ice but also breaks up the spiral of ice into fragments of a specific desired size within a very narrow tolerance of ±10%. This is to some extent the result of achieving the requisite compacting action, which results in turn from getting the scraped off thin coating of ice to jam up so that a spiral of ice will form over the whole space between the threads. This compacting probably does not result from the knives alone but from the deflecting surfaces of the knives and deflector and their angle to the direction in which the ice spiral is conveyed. This must lead to the ice not being obstructed in its flow between the cutters, so that it will not get jammed or wedged up at that point but will flow through the series of cutters while simultaneously getting broken up into fragments. The angle at which the deflection surfaces are adjusted can vary from 50° to about 60° to the direction in which the spiral of ice is conveyed. A greater angle will increase the hardness of the ice and a smaller angle promote the flow of the spiral or fragments of ice. An angle of 55° produces outstanding results. A device of this type makes it possible in particular to determine and control the cross-section, meaning the height and width, of the fragments of ice. Their height is determined by the height of the thread of the conveyer worm. Their width is determined by the interval between two adjacent cutters or between the deflector and the first subsequent cutter. Surprisingly, the thickness of the cutters, which at least partly block from this aspect the overall threaded cross-section, plays no part in this context. Obviously, the space between the threads and the desired width of the fragments of ice determine the number of cutters. It is preferable, especially when the fragments of ice are not to be very wide—only 4 to 7 mm—for the conveyer worm to have two threads with each interthread space being divided by the cutters and on deflector. The edges must be positioned on the side of the cutters that faces the conveying side of the threads to prevent the ice from getting wedged in any case in the cross-section between adjacent cutters.

The cutters may have a guide surface adjoining the edge and more or less parallel to the direction in which the spiral of ice is conveyed or to the thread or with a cross-section of penetration that is slightly expanded in the direction of conveyance with respect to the conveying side of the thread. This will prevent the fragments of ice from getting wedged between two cutters and will promote the flow of ice through the obstruction.

The cutters, which are mounted next to each other as a unit, and the deflector can be shaped and positioned in the space between the threads in such a way that the cross-section of penetration for the strips or chips of ice formed out of the spiral will remain more or less constant over the deflection surfaces. This is especially true as well at the point where the strips of ice are diverted and at the nominal breakup point that forms where the strips of ice are broken down into chips or fragments. The cross-section should not narrow at all at this point if at all possible. The ice has already been contacted by the time it arrives at this point. The only essential here is to obtain a fragment size that is as uniform as possible while avoiding further compacting, so that the fragments of ice can be removed.

The cutters can be positioned in a cascade in the space between the threads and there can be an open space downstream of the cutters that merges into the ice outlet without providing any compacting. This design will maintain the shape of the fragments of ice as they travel from the cutters to the ice outlet. The fragments of ice will come into only loose contact with each other only at this point and only to the extent necessary to convey them.

There can also be two ice outlets adjoining the open space when the conveyer worm has two threads so that the fragments of ice of a fixed size will be conveyed over the shortest possible distance and without interacting.

The cutters are as a rule positioned mutually displaced axially along the direction in which the spiral of ice is conveyed. The cutters are mounted at the same height off the conveyer worm. The size, shape, and position of the cutters depend on the desired dimensions of the grains of ice. The cutters may be oblong. The must of course have an appropriate thickness on the basis of strength alone. The cutters may also be essentially triangular with a guide surface and a deflection surface extending out from the edge.

The deflector and the cutters must not prevent the chips or fragments of ice from flowing through this obstruction. The cutters can accordingly be positioned displaced in conjunction with each other in the space between the threads in such a way that the end of the guide surface of each of two adjacent cutters that faces away from the edge and that is farther away from the conveying side of the thread will be outside the projection of the other cutter that begins with the edge and perpendicular to the direction in which the spiral of ice is being conveyed. It is, however, also possible, and even necessary when the pieces of ice are to be very narrow, for this projection of the edge to extend approximately into the vicinity of the rear edge of the guide surface.

The length of the cutters is also connected with the width of the fragment of ice. There is also a relation to the lead of the conveyer-worm thread. The thread, and hence the cutters and their guide surfaces as well, can be positioned at a lead of 72 mm for an outside thread diameter of 90 mm. It is preferable to mount the deflector at the end of the conveyer thread.

Figure 2:
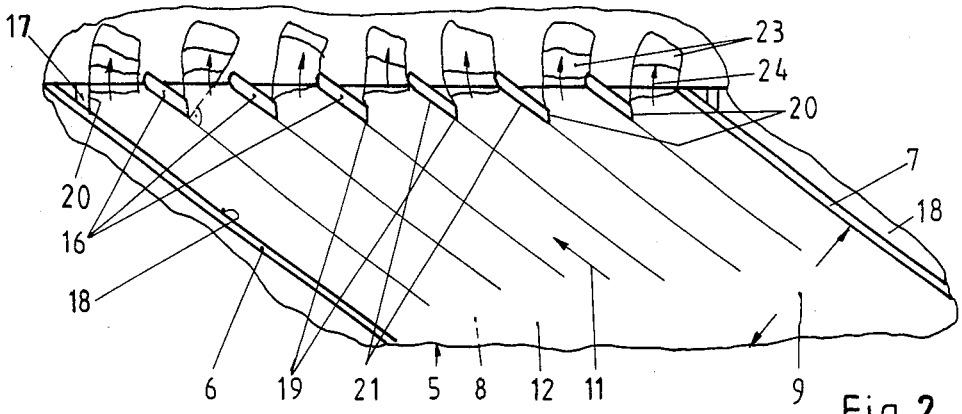
Figure 3:
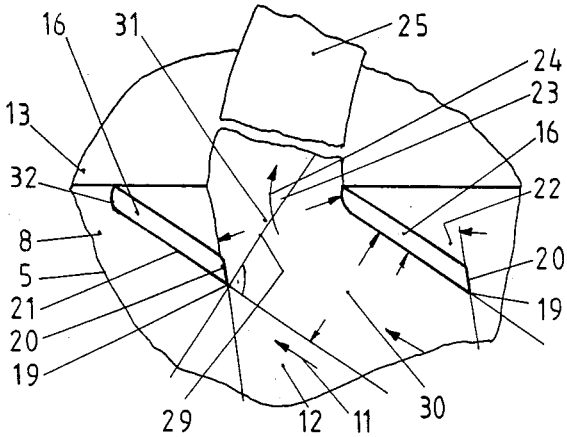
Figure 4:
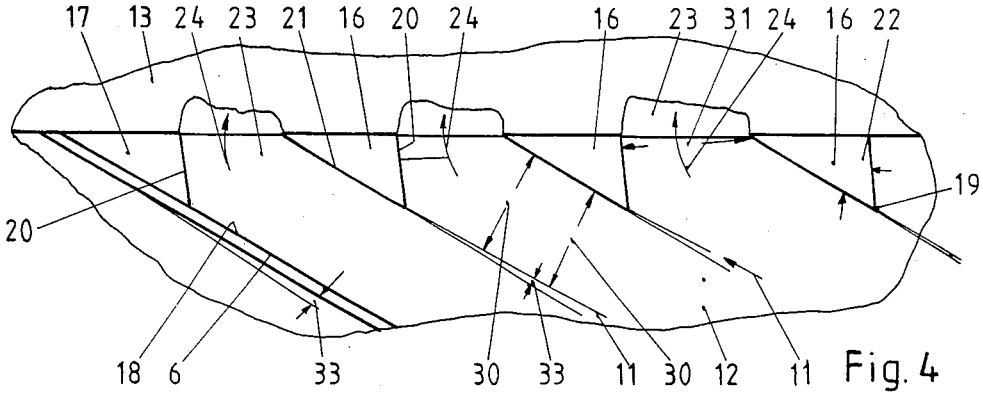
Figure 5:
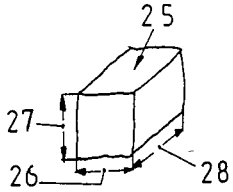

Some embodiments of the invention will now be specified by way of example with reference to the drawings, in which FIG. 1 is a vertical section through the top of the device, FIG. 2 is a developed view of the circumference of the conveyer worm in the area of interest, FIG. 3 is an enlarged section of the illustration in FIG. 2, FIG. 4 is a view similar to that in FIG. 2 but with an obstruction that is differently shaped and positioned, and FIG. 5 is a diagram of a grain or fragment of ice.

The length of cylinder 1 illustrated in FIG. 1 is about one third to one half of the total cylinder. Cylinder 1 has an inside wall surface 2 surrounded by the coil 3 of a freezer that carries off heat. The cylinder as a whole is provided with more or less continuous insulation 4. A conveyer worm 5, with two threads 6 and 7 in this particular case, is mounted inside cylinder 1. Conveyer worm 5 has a core 8. There is a space 9 between the two adjacent threads 6 and 7 and outside core 8. If conveyer worm 5 is single-flight and has only one thread 6, it will also have a space 9 between the turns of the single thread. Conveyer worm 5 is powered to rotate in the sense indicated by the arrow 10 in such a way that thread 6 or threads 6 and 7 will continuously scrape off the thin coating of ice that forms on the inside wall surface 2 of cylinder 1 and convey it in the direction indicated by arrow 11. The direction of conveyance indicated by arrow 11 equals or parallels the lead of the thread or threads. The space 9 between the threads becomes increasingly and finally completely full of ice from the bottom up, the thin coating of ice becoming accordingly concentrated, compacted, and drained of water. A spiral 12 of ice, only a small part of which is illustrated for simplicity's sake, forms at the top. Above threads 6 and 7, conveyer worm 5 is adjoined by an unthreaded cylindrical section 13 surrounded by an annular space 14 that communicates with two ice outlets 15 positioned radially at an angle of 180° to each other.

At the end of the space 9 between the threads and hence at the transition of the threaded section of conveyer worm 5 to cylindrical section 13 several cutters 16 are distributed at equal intervals over space 9 and a deflector 17 is mounted on conveyer worm 5. Deflector 17 directly engages the conveying side 18 of each thread 6 or 7. The strip 12 of ice is cut up into a number of individual chips that equals the total number of cutters 16 plus deflector 17, bent, and hence broken off in such a way that individual fragments of ice, all of them having the same shape, will be formed at this point. The cutters and deflector are about as high as threads 6 or 7. This determines the height of the fragments of ice. The distance between adjacent cutters or between deflector 17 and the first cutter 16 and perpendicular to the direction indicated by arrow 11 in which the spiral 12 of ice is being conveyed determines the width of the fragments of ice. One deflector 17 and three cutters 16 for instance will divide interthread space 9 in three. If conveyer worm 5 has two threads, this will occur at two points.

FIGS. 2 through 4 illustrate how the device operates. Each is a developed view of a section of conveyer worm 5 at the transition point, which is the area most relevant to the invention.

FIG. 2 illustrates one embodiment of cutters 16 and deflector 17, which are secured on the core 8 of conveyer worm 5 as indicated, and rotate with the core. Each cutter 16 has an edge 19 facing the conveying side 18 of thread 6 and a deflecting surface 20 adjoining the edge. Subsequent to the other side, each cutter 16 has a guide surface 21 adjoining edges 19 and designed or positioned parallel to the direction indicated by arrow 11 in which the spiral 12 of ice is conveyed. Each deflector 17 adjoins the particular thread 6 or 7 at conveying side 18 and in itself has only one deflecting surface 20. The deflecting surface 20 of each cutter 16 and of deflector 17 is positioned at a particular angle to the direction indicated by arrow 11 in which the spiral 12 of ice is conveyed. The angle 22 between deflecting surface 20 and guide surface 21 ranges from 50° to 60° and is preferably about 55°. Angle 22 is especially evident in FIG. 3. The slant of deflecting surfaces 20 in relation to the direction of conveyance indicated by arrow 11 is essential not only to compact and drain ice spiral 12 of water but also to deflect or divert chips 23 of ice in the direction indicated by arrows 24. Deflection also separates chips 23 of ice into separate fragments or grains by creating transverse cracks and determines the length of the fragments. FIG. 5 is an idealized diagram of a grain or fragment 25 of ice with a width 26, a height 27, and a length 28. These dimensions can be controlled by varying the number, design, and position of cutters 16 and deflector 17 and selected for various applications. It it quite simple for example to make ice fragments that are 5 mm wide, 5 mm high, and 3 to 6 mm long with a tolerance of only ±10%. In another embodiment that has already been tested, fragments 25 of ice have been made that were 10 mm wide, 8 mm high, and 15 mm long. Other dimensions are very simple to obtain.

FIG. 3 once again illustrates the relationships in the embodiment illustrated in FIG. 2. The two adjacent cutters 16 are displaced in relation to each other in such a way that the edge 19 of the cutter 16 that is nearer the conveying side 18 of thread 6 is perpendicular to guide surface 21 or to the direction of conveyance indicated by arrow 11 outside the area that relates to the adjacent cutter 16, the one farther away from thread 6. This ensures that the cross-sections 30 and 31 of penetration for the chips 23 of ice traveling through the cascaded cutters 16 will not decrease but will only deviate. For this purpose the rear of cutters 16 can exhibit round-offs 32 where they adjoin guide surfaces 21.

FIG. 4 is almost identical, the only difference being that cutters 16 and deflector 17 are designed and mounted with a triangular cross-section. This extends or expands the deflecting surfaces 20 in comparison with those in FIGS. 2 and 3 so that the deflection of the chips 23 of ice as indicated by arrows 24 is prolonged and the break occurs relatively later and less often, increasing the overall length 28 of the chips. To prevent jamming and hence obstruction of the flow of the spiral 12 of ice to be divided up through the cascaded cutters 16 and deflector 17, guide surfaces 21 have been sloped in this embodiment at such a slight angle 33 to the direction in which spiral 12 of ice is conveyed as indicated by arrow 11 that cross-section 30 of penetration merges into a slightly expanded cross-section 30'. Cross-section 31 of penetration will in this case as well not essentially impede the flow of the chips 23 of ice being diverted in the direction indicated by arrows 24.

As will be especially obvious from FIGS. 2 through 4 in connection with the illustration of the device in FIG. 1, the compressed, compacted, and drained spiral 12 of ice will be fully conveyed as indicated by arrow 11 along the space 9 between the threads. The first cutter 16, which faces away from the conveying side 18 of the thread, will now cut the first chip 23 of ice from spiral 12 and deflect it, the deflection breaking it at a point appropriate for the length 28 of grains 25 of ice. This procedure is repeated at each subsequent left cutter 16 until just one chip 23 of ice is left, which is then deflected by deflector 17 its deflecting surface 20. The grains 25 of ice that are formed and sized in this way then arrive without further compacting in ice outlet or outlets 15. Continuous conveyance forces grains 25 of ice loosely out of ice outlets 15 at which point they can be employed for their intended purpose.

I claim:

1. Apparatus for producing fragmented ice comprising: a substantially vertical and externally chilled cylinder; an ice outlet at the top of the cylinder; a powered conveyor worm mounted in said cylinder and continuously scraping off a thin coating of ice forming on the inside of a wall of said cylinder, said conveyor worm having at least one thread for conveying scraped off ice in a helix toward said ice outlet; obstruction means at the top of said conveyor worm to break the helix of ice up into fragments; said obstruction means having a plurality of cutters distributed at regular intervals, and deflector means engaging a conveying side of a thread; each of said cutters having an edge on a side facing a conveying side of the thread; each cutter having a deflecting surface adjoining the cutter edge; all deflecting surfaces being parallel and positioned at an angle of substantially 50° to 60° to a direction in which the helix of ice is conveyed; said cutters having a guide surface adjoining said edge and being substantially parallel to the direction in which the helix of ice is conveyed; said cutters being substantially narrow elongated members for fragmenting ice free from compression and ramming effects, said ice being only deflected and broken apart.

2. Apparatus as defined in claim 1, wherein said cutters are mounted next to each other as a unit; said deflector means being shaped and positioned so that said cross-section of penetration for strips or chips of ice formed out of the helix remains substantially constant over the deflection surfaces.

3. Apparatus as defined in claim 1, wherein said cutters are positioned in a cascade, an open space downstream of said cutters merging into said ice outlet free from compacting.

4. Apparatus as defined in claim 3, wherein two ice outlets adjoin said open space when said conveyor worm has two threads.

5. Apparatus as defined in claim 1, wherein said cutters are positioned mutually displaced axially along direction of conveyance of the helix of ice.

6. Apparatus as defined in claim 5, wherein said cutters are substantially triangular; a guide surface and a deflection surface extending out from said edge.

7. Apparatus as defined in claim 5, wherein said cutters are positioned displaced relative to each other so that an end of said guide surface of each of two adjacent cutters facing away from said edge and farther away from said conveying side of the thread will be outside a projection of the other cutter beginning with said edge and perpendicular to a direction in which said helix of ice is being conveyed.

8. Apparatus as defined in claim 1, wherein said deflector means is mounted at the end of the conveyor thread.

9. Apparatus for producing fragmented ice comprising: a substantially vertical and externally chilled cylinder; an ice outlet at the top of the cylinder; a powered conveyor worm mounted in said cylinder and continuously scraping off a thin coating of ice forming on the inside of a wall of said cylinder, said conveyor worm having at least one thread for conveying scraped off ice in a helix toward said ice outlet; obstruction means at the top of threads on said conveyor worm to break the helix of ice up into fragments; said obstruction means having a plurality of cutters distributed at regular intervals, and deflector means engaging a conveying side of a thread; each of said cutters having an edge on a side facing a conveying side of the thread; each cutter having a deflecting surface adjoining the cutter edge; all deflecting surfaces being parallel and positioned at an angle of substantially 50° to 60° to a direction in which the helix of ice is conveyed; said cutters having a guide surface adjoining said edge and being substantially parallel to the direction in which the helix of ice is conveyed, said cutters being substantially narrow elongated members for fragmenting ice free from compression and ramming effects, said ice being only deflected and broken apart; said cutters being mounted next to each other as a unit; said deflector means being shaped and positioned so that said cross-section of penetration for strips or chips of ice formed out of the helix remains substantially constant over the deflection surfaces, said cutters being positioned mutually displaced axially along direction of conveyance of the helix of ice, said cutters being substantially triangular; a guide surface and a deflection surface extending out from said edge, said deflector means being mounted at the end of the conveyor thread.

* * * * *